US011517157B2

(12) United States Patent
Choi et al.

(10) Patent No.: US 11,517,157 B2
(45) Date of Patent: Dec. 6, 2022

(54) CORDLESS BENCHTOP CLEANING LIQUID DISPENSER

(71) Applicant: Lumi International Limited, Chai Wan (HK)

(72) Inventors: Wai Shun Choi, Chai Wan (HK); Chun Shing Cheng, Chai Wan (HK)

(73) Assignee: Lumi International Limited, Chai Wan (HK)

( * ) Notice: Subject to any disclaimer, the term of this patent is extended or adjusted under 35 U.S.C. 154(b) by 0 days.

(21) Appl. No.: 17/524,091

(22) Filed: Nov. 11, 2021

(65) Prior Publication Data

US 2022/0142413 A1 May 12, 2022

(30) Foreign Application Priority Data

Nov. 12, 2020 (HK) ..... 32020019940.6

(51) Int. Cl.
*A47K 5/12* (2006.01)

(52) U.S. Cl.
CPC ..... *A47K 5/1202* (2013.01); *A47K 5/1217* (2013.01); *A47K 2005/1218* (2013.01)

(58) Field of Classification Search
CPC ..... A47K 5/1202; A47K 5/1217; A47K 2005/1218
See application file for complete search history.

(56) References Cited

U.S. PATENT DOCUMENTS 4,189,098 A 2/1980 Wagner
6,467,651 B1 * 10/2002 Muderlak ..... A61L 9/145 222/63
2009/0166381 A1 * 7/2009 Phelps ..... A47K 5/12 222/173
2011/0127291 A1 * 6/2011 Tramontina ..... B05B 11/3001 222/638
2013/0075420 A1 * 3/2013 Tramontina ..... B05B 11/3052 222/1
2014/0231450 A1 * 8/2014 Rosko ..... G01D 5/24 222/52
2021/0059481 A1 * 3/2021 Bai ..... A47K 5/16

FOREIGN PATENT DOCUMENTS

| | | |
|---|---|---|
| CN | 1812846 | 8/2006 |
| CN | 101267893 | 8/2010 |
| CN | 103874442 | 6/2014 |
| CN | 101600510 | 9/2021 |

* cited by examiner

*Primary Examiner* — Jeremy Carroll
(74) *Attorney, Agent, or Firm* — Renner Kenner Greive Bobak Taylor & Weber

(57) ABSTRACT

A cordless benchtop dispenser for dispensing cleaning liquids includes a container, a housing, and a coupler body structured to effectively provide a single-use container, mitigating possible contamination or hygiene risks associated with users refilling the container as well as operation risks associated with users refilling the container with incompatible liquids or chemicals. In some embodiments, a benchtop dispenser is provided wherein pressing the coupler body onto a neck of the container causes the coupler body to be permanently fixed to the neck. In some embodiments, a benchtop dispenser includes a photoelectric sensor that triggers the controller to operate the motor for a predetermined period, and subsequently triggers the controller to start a timer and actuate the indicator based on elapsed times measured by the timer.

18 Claims, 4 Drawing Sheets

CORDLESS BENCHTOP CLEANING LIQUID DISPENSER

TECHNICAL FIELD

The invention relates to a cordless benchtop dispenser for dispensing cleaning liquids.

BACKGROUND

Cleaning liquid dispensers are commonly used in kitchens, toilets, and laboratories to dispense cleaning liquids such as soap for washing hands.

Some existing cleaning liquid dispensers are manually operated. This type of dispenser includes a cleaning liquid container, a nozzle coupled with the cleaning liquid container, and a manual actuator that a user can actuate to operate a valve to dispense cleaning liquid from the cleaning liquid container via the nozzle. In use, the user actuates the dispenser's actuator to dispense the cleaning liquid. Such operation is inconvenient and may present a hygiene risk as different users will contact the same actuator so harmful and unwanted substances (e.g., viruses, bacteria, microorganisms, dirt, grease, etc.) may pass between users.

Some other existing cleaning liquid dispensers are electrically operated. This type of dispenser includes a housing holding a cleaning liquid container, a nozzle coupled with the cleaning liquid container, and a circuit with proximity sensor near the nozzle for sensing a presence of an object (e.g., a hand) to operate a motor-pump to dispense cleaning liquid from the cleaning liquid container via the nozzle. In use, the user places his or her hand near the nozzle; the proximity sensor detects the user's hand and operates the motor-pump to dispense cleaning liquid. In the process, the user does not have to contact the dispenser. In some implementations, when the cleaning liquid in the cleaning liquid container is used up, the user can refill the container with cleaning liquid. The refilling of the container with cleaning liquid may present contamination or hygiene risks, which is undesirable. On the other hand, the function of these dispensers is generally restricted to dispensing cleaning liquids only.

SUMMARY

According to a first aspect there is provided a cordless benchtop dispenser for dispensing cleaning liquids such as liquid soap, sanitizer, antibacterial soap/foam, etc. the dispenser comprising:

a container with a neck that comprises at least one first peripheral rib, the neck extending about an opening;

a housing with a lower part that is configured to rest on top of the container and which defines a liquid inlet, and an upper projecting part holding a nozzle; a motor-driven pump in the housing for drawing liquid through the liquid inlet and dispensing the liquid from the nozzle;

a coupler body comprising a skirt portion complementary to the neck, the skirt portion comprising at least one second peripheral rib, a through-extending liquid passage in the coupler body, a suction tube fixed to the coupler body and defining a length of the through-extending liquid passage, wherein male coupler features comprise a plurality of circumferentially spaced projections that extend radially, and complementary female coupler features comprise a plurality of circumferential slots each adapted to receive a respective one of the circumferentially spaced projections, and one of the male and female coupler features is disposed on the coupler body, and the other of the male and female coupler features is disposed on the housing such that relative rotation connects the housing to the container, and wherein, by pressing the coupler body onto the neck and thereby forcing the second peripheral rib over the first peripheral rib, the coupler body is permanently fixed to the neck.

The dispenser thus effectively comprises a single-use container, mitigating possible contamination or hygiene risks associated with users refilling the container as well as operation risks associated with users refilling the container with incompatible liquids or chemicals.

The first and second peripheral ribs may each comprise a plurality of lengths that are circumferentially spaced apart in a like manner, so that respective lengths on the neck and skirt portion are in registration with one another. Preferably the lengths on each of the neck and skirt portion all lie in a respective common transverse plane. Alternatively, one or each of the first and second peripheral ribs may comprise an unbroken peripheral rib extending around an external, or internal, periphery of the neck and skirt portion.

Optionally the circumferential slot comprises a helical face that engages the projection, such that the relative rotation draws the container and housing together. Optionally the helical face further comprises a detent nub.

Optionally the neck has an axis and the first and second peripheral ribs have respective outer faces acutely inclined to the axis and which abut during pressing of the coupler body onto the neck, and respective inner faces acutely inclined to the axis that abut to prevent later removal of the coupler body, wherein an angle of inclination of the inner faces to the axis is greater than an angle of inclination of the outer faces to the axis.

Optionally one of a recess and complementary projection are integrally formed with the neck and the other of the recess and complementary projection are integrally formed with the coupler body, to prevent relative rotation between the coupler body and the neck about the axis.

Optionally the circumferentially spaced projections are formed in a flange that extends transversely to the skirt portion, and the circumferential slots are formed inside a sleeve portion of the housing.

Optionally the housing comprises: a hollow main body member with a lowermost edge sized to rest in an annular channel in the top of the container, and a base member recessed inside the lowermost edge to cover the lower end of the hollow main body member.

Optionally the upper projecting part of the housing comprises abutting sections of the main body member and a top member that covers a top end of the hollow main body member.

Optionally an outer end of the upper projecting part is closed by an elliptical member, a perimeter of the elliptical member received in arcuate slots in the main body member and top member.

Optionally the sleeve portion is formed in the base member.

Optionally the dispenser further comprises a sealing plug for temporarily sealing the through-extending liquid passage. Optionally the sealing plug further comprises a web extending transversely and a locating plug aligned with the sealing plug and integral with the web, wherein an aperture is disposed adjacent the through-extending liquid passage for receiving the locating plug.

In a second aspect there is provided a cordless benchtop dispenser for dispensing cleaning liquids such as liquid soap, sanitizer, antibacterial soap/foam, etc. The dispenser comprising:

a container, a coupler body and a housing, the housing having a lower part that is configured to rest on top of the container and which defines a liquid inlet, and an upper projecting part holding a nozzle;

a motor and a pump driven by the motor in the housing for drawing liquid through the coupler body and the liquid inlet and dispensing the liquid from the nozzle;

a photoelectric sensor adjacent the nozzle;

a power supply in the housing;

an indicator arranged on the housing;

a control circuit connected to the power supply and photoelectric sensor and comprising a controller for controlling the motor and the indicator, wherein activation of the photoelectric sensor triggers the controller to operate the motor for a predetermined period, and subsequently triggers the controller to start a timer and actuate the indicator based on elapsed times measured by the timer.

Optionally the indicator comprises an array of light emitters disposed in at least one recess in the housing, in which case: activation of the photoelectric sensor triggers the controller to operate the motor for the predetermined period, and subsequently triggers the controller to start the timer and actuate the light emitters successively at respective elapsed times measured by the timer.

Optionally, the indicator may include an audible indicator (e.g., a sound generator, a buzzer, a speaker) and/or a visual indicator (electronic display screen, lights such as LED).

Optionally the predetermined period may be 1 second, 1.5 seconds, etc. The timer may be triggered upon the predetermined period has elapsed, upon activation of the photoelectric sensor, upon deactivation of the photoelectric sensor, etc.

By setting the elapsed times to, for instance, percentages of a desired total elapsed time, such as a recommended time period for washing hands, progress toward that time is indicated, as well as the end of the time period (when all of the emitters are illuminated).

Optionally a different elapsed time is associated with each light emitter and the elapsed times are predetermined. Alternatively, an input device connected in the circuit may allow for the elapsed times to be set by the user.

Optionally deactivation of the motor triggers the controller to start the timer.

Optionally the at least one recess comprises a separate emitter-receiving recess for receiving each emitter.

Optionally a one-piece lens comprises lens portions substantially flush with the housing and received in each of the emitter-receiving recesses.

Optionally a translucent cover extends over the photoelectric sensor and the nozzle extends through an opening in the translucent cover.

Optionally the emitter-receiving recesses are disposed in an uppermost member of the housing and the light emitters comprise LEDs mounted on a circuit board fixed to the uppermost member. The LEDs may be single-coloured LEDs, dual-coloured LEDs, or multi-coloured LEDs.

Optionally the uppermost member is reinforced near the emitter-receiving recesses by integral internal ribs, such as a curved rib extending to encompass the emitter-receiving recesses.

In a third aspect, there is provided a container assembly for a cordless benchtop dispenser. The container assembly comprises:

a container with a neck that comprises at least one first peripheral rib, the neck extending about an opening;

a coupler body comprising a skirt portion complementary to the neck, the skirt portion comprising at least one second peripheral rib, a through-extending liquid passage in the coupler body, a suction tube fixed to the coupler body and defining a length of the through-extending liquid passage, wherein the coupler body includes one of a male coupler feature and a female coupler feature complementary to the male coupler feature; and a housing of the benchtop dispenser or a cap for the coupler body includes the other one of the male coupler feature and the female coupler feature such that relative rotation connects the container to the housing or the cap;

the male coupler features comprise a plurality of circumferentially spaced projections that extend radially, and the female coupler features comprise a plurality of circumferential slots each adapted to receive a respective one of the circumferentially spaced projections, and wherein, by pressing the coupler body onto the neck and thereby forcing the second peripheral rib over the first peripheral rib, the coupler body is permanently fixed to the neck.

Optionally, the container assembly further comprises the cap.

Optionally the circumferential slot comprises a helical face that engages the projection, such that the relative rotation draws the container and the housing or the cap together. Optionally the helical face further comprises a detent nub.

Optionally the neck has an axis and the first and second peripheral ribs have respective outer faces acutely inclined to the axis and which abut during pressing of the coupler body onto the neck, and respective inner faces acutely inclined to the axis that abut to prevent later removal of the coupler body, wherein an angle of inclination of the inner faces to the axis is greater than an angle of inclination of the outer faces to the axis.

Optionally one of a recess and complementary projection are integrally formed with the neck and the other of the recess and complementary projection are integrally formed with the coupler body, to prevent relative rotation between the coupler body and the neck about the axis.

Optionally the coupler body further includes a flange that extends transversely to the skirt portion, the circumferentially spaced projections are formed in the flange.

Optionally the container assembly further comprises a sealing plug for temporarily sealing the through-extending liquid passage. Optionally the sealing plug further comprises a web extending transversely and a locating plug aligned with the sealing plug and integral with the web, wherein an aperture is disposed adjacent the through-extending liquid passage for receiving the locating plug.

Optionally, the container contains cleaning liquid is substantially filled with cleaning liquid. The cleaning liquid may include liquid soap, sanitizer, antibacterial soap/foam, etc.

Other features and aspects of the invention will become apparent by consideration of the detailed description and accompanying drawings. Any feature(s) described herein in relation to one aspect or embodiment may be combined with any other feature(s) described herein in relation to any other aspect or embodiment as appropriate and applicable.

BRIEF DESCRIPTION OF THE DRAWINGS

Embodiments of the invention will now be described, by way of example, with reference to the accompanying drawings, in which.

DETAILED DESCRIPTION

Figure 1:
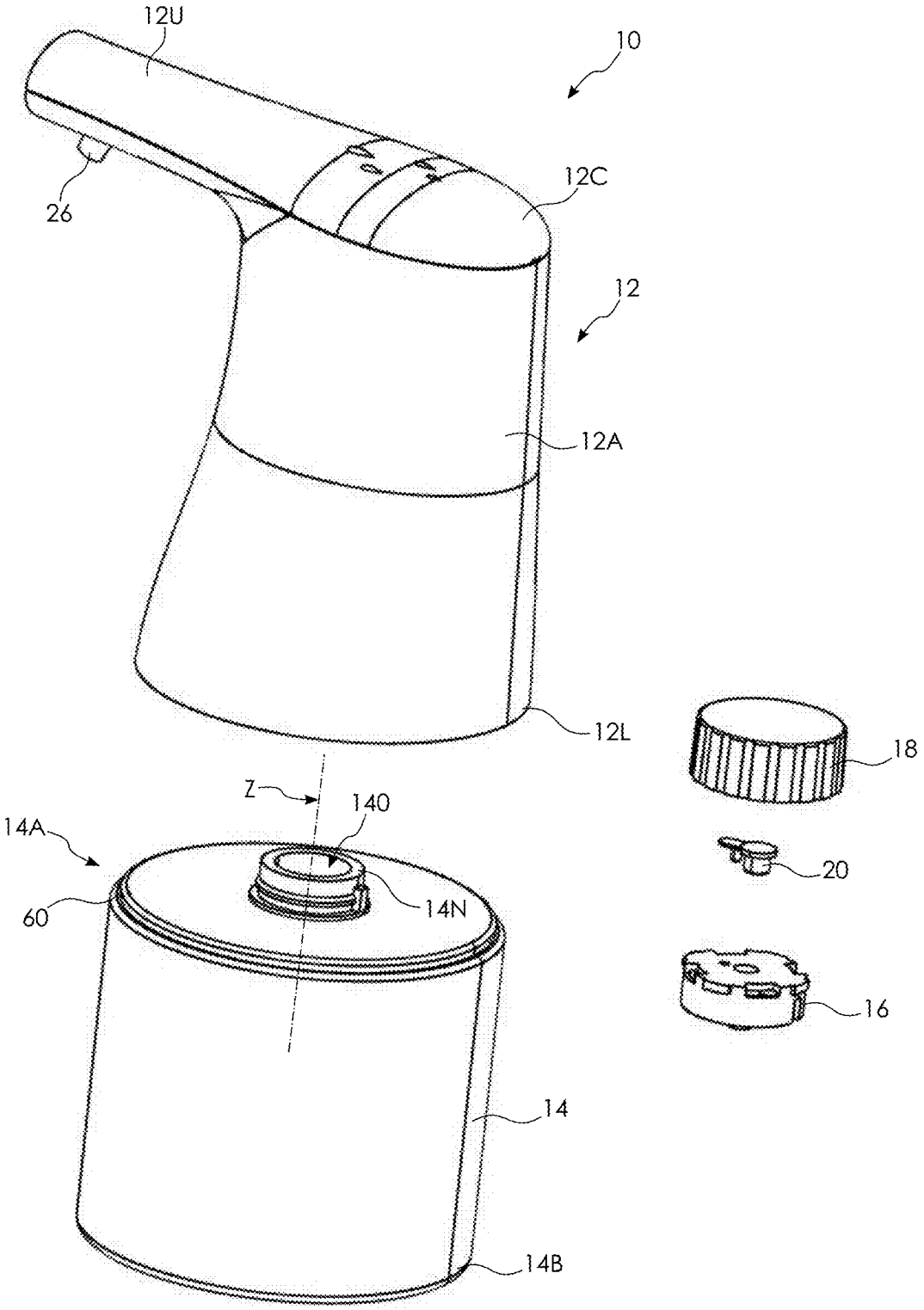
FIG. 1 is a schematic view of a cordless benchtop dispenser in one embodiment of the invention.
Figure 2:
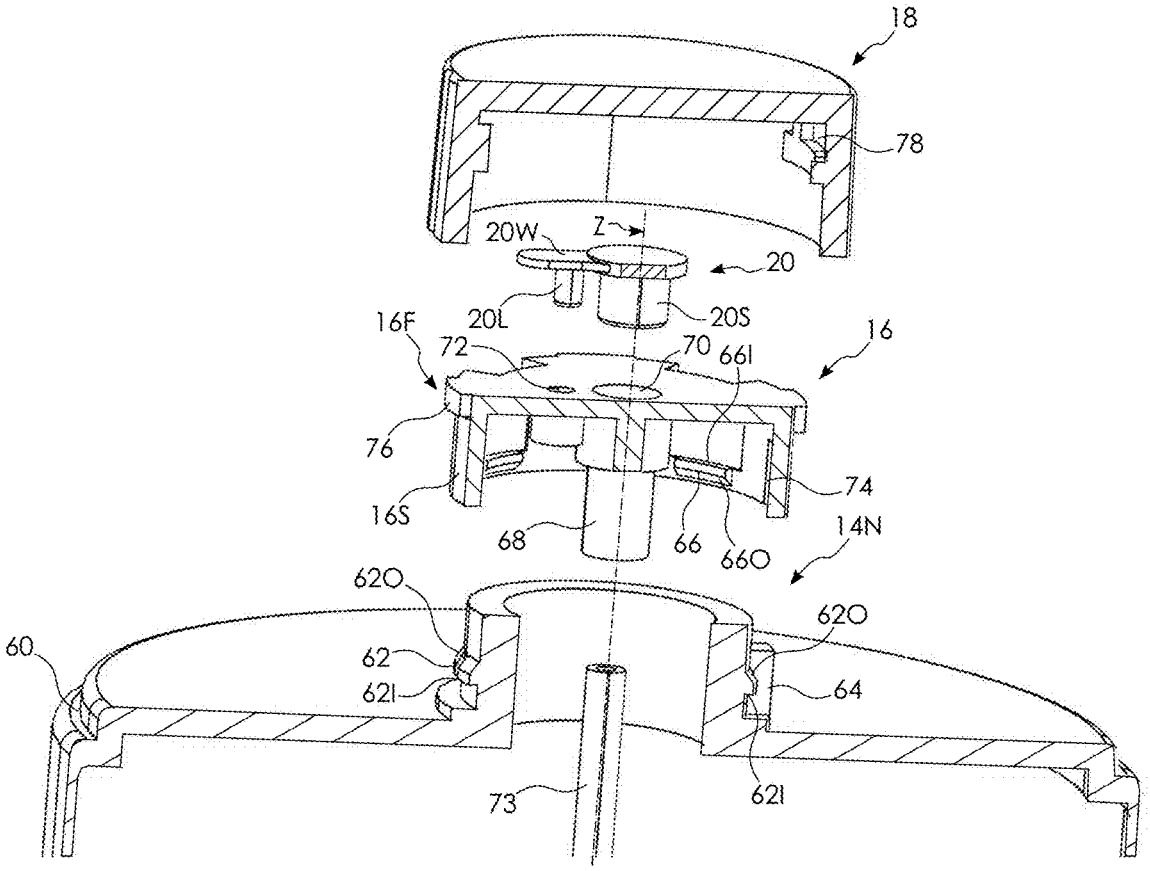
FIG. 2 is a cutaway view of the container of the dispenser of FIG. 1.

Referring to FIGS. 1 to 5, the cordless benchtop dispenser assembly 10 generally includes a housing 12, a container 14 for coupling to the housing 12, and a coupler body 16 permanently fixed to the container 14 (but shown separated from the container 14 in FIGS. 1 and 2). By permanently fixing the coupler body 16 to the container 14, the coupler body 16 cannot be easily removed from the container 14 without using tools or without damaging the coupler body 16 or the container 14. New replacement containers may be provided for refill purposed, each including a cap 18 for the container 14 and a sealing plug 20 for the coupler body 16. The cap 18 is removed from the container 14 (installed with the coupler body 16), and the sealing plug 20 is removed from the coupler body 16, before coupling the container 14 with the coupler body 16 to the housing 12. The housing 12, the container 14, and the coupler body 16 are made of plastic.

The housing 12 is formed by a hollow main body member 12A, a base member 12B that covers a lower end of the hollow main body member 12A, and a top member 12C that covers a top end of the hollow main body member 12A. The hollow main body member 12A is generally rounded and has a flared lower portion. The hollow main body member 12A defines a lowermost edge 12L. The base member 12B is recessed inside the lowermost edge 12L (above a plane defined by the lowermost edge 12L) to cover the lower end of the hollow main body member 12A. A generally annular sleeve portion 12BS is formed in the base member 12B, arranged centrally and extending downwardly away from the base member 12B. A liquid inlet 22 is arranged in the sleeve portion 12BS. Sections of the main body member 12A and the top member 12C abut to form an upper projecting part 12U of the housing 12. An outer end of the upper projecting part is closed by an elliptical member 24, the perimeter of which is received in arcuate slots in the main body member 12A and top member 12C.

Figure 3:
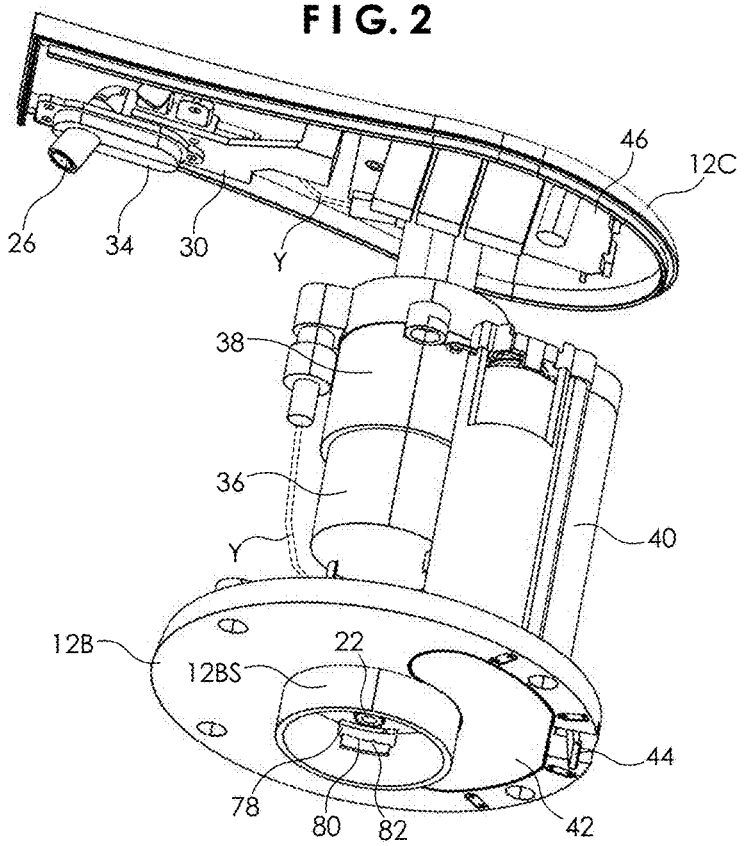
FIG. 3 is a perspective view of the housing of the dispenser of FIG. 1, with the hollow main body member of the housing removed.
Figure 4:
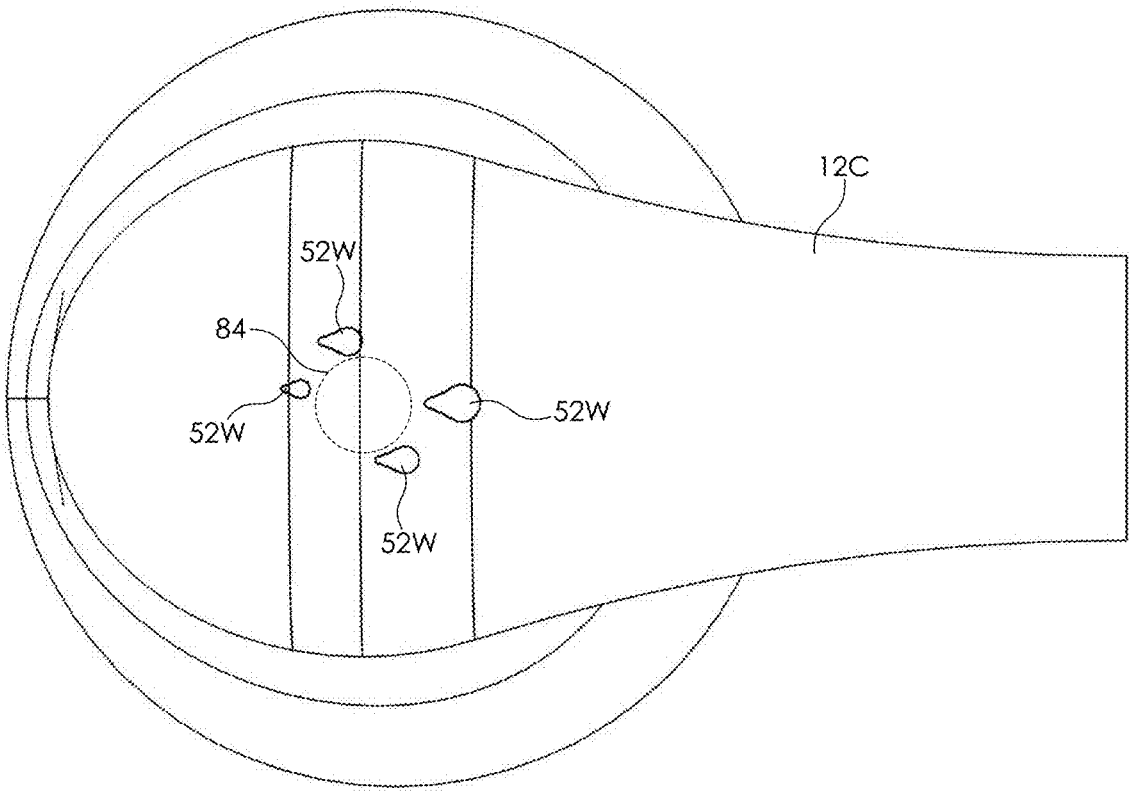
FIG. 4 is a top view of the housing of the dispenser of FIG. 1.
Figure 5:
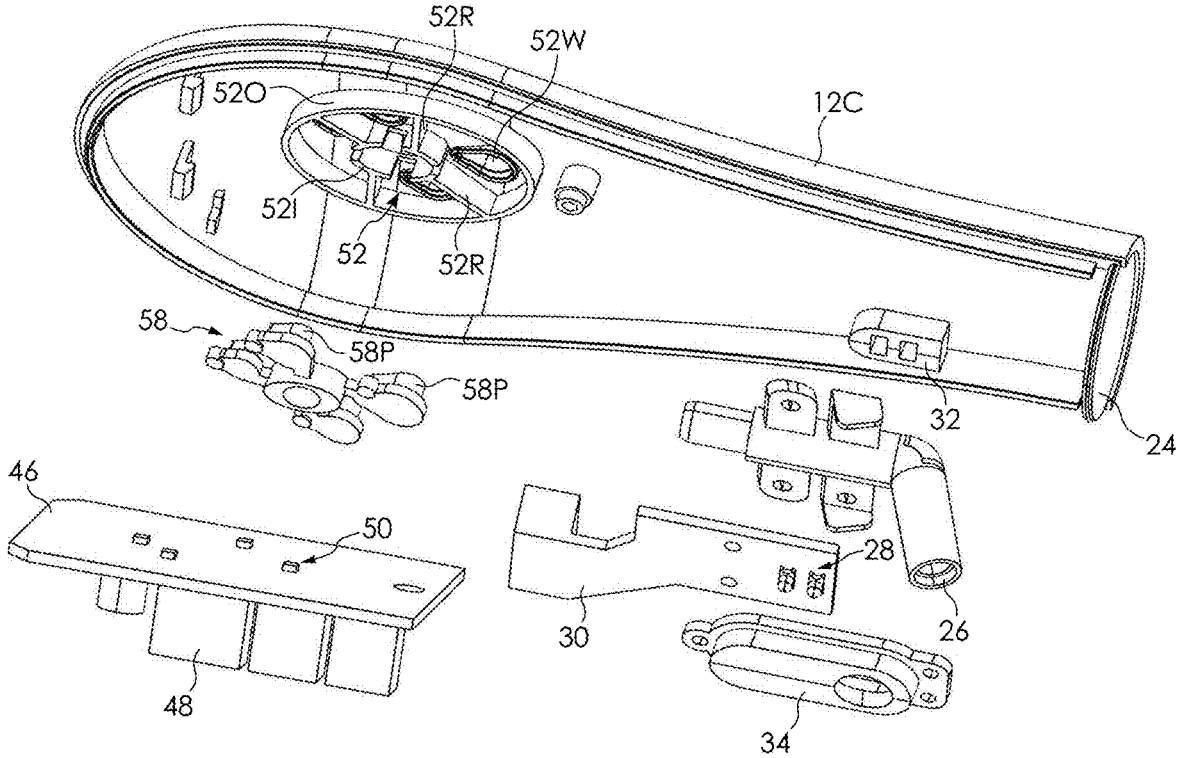
FIG. 5 is a schematic exploded view of the upper part of the dispenser of FIG. 1.

FIGS. 1, 3, and 5 show the components in the housing 12. The upper projection part 12U of the housing 12 holds a nozzle 26 for dispensing cleaning liquid. A photoelectric sensor, formed by an infrared transmitter and receiver pair 28, is arranged adjacent the nozzle 26 to detect presence of a user's hand. The infrared transmitter and receiver pair 28 are arranged on an underside of a circuit board 30 and in two slots defined in a guide member 32 mounted to the circuit board 30. A translucent cover 34 extends over the infrared transmitter and receiver pair 28 and the guide member 32 from below. The translucent cover 34 defines an opening through which the nozzle extends. Infrared signals can pass through the cover 34.

A motor 36 and a pump 38 driven by the motor 36 are arranged in the housing 12, raised from the base member 12B and secured to the main body member 12A by fasteners, for drawing liquid from the container 14 through the coupler body 16 and the liquid inlet 22 to dispense the liquid from the nozzle 26, e.g., following the representative dotted lines Y that represent the flow path (tubes fluidly connecting the inlet 22, the pump 38, and the nozzle 26 are not shown in FIG. 3). A battery receptacle 40 is arranged in the housing 12 extending generally upwardly from the base member 12B. The battery receptacle 40 includes four battery cell ports, arranged generally circumferentially about the motor 36 and pump 38, for receiving battery cells to power the operation of the dispenser. A battery receptacle cover 42 is mounted to the base member 12B and can be removed by the user via an integral latch 44 formed on the cover 42 for inserting or removing the battery cells.

A further circuit board 46 is arranged above the motor 36 and pump 38 and adjacent the other circuit board 30, and is fixed to the top member 12C. The two circuit boards 30, 46 are electrically connected (connection not shown). The lower side (the side facing the pump 38) of the circuit board 46 is mounted with, among other electronic components (such as resistors, capacitors, inductors, various active/passive devices), a main controller 48 that controls the operation of the dispenser. The main controller 48 is connected to the power supply to control operation of the motor 36 and pump 38 and the LEDs, as disclosed further below. The upper side of the circuit board 46 is mounted with a LED array 50 of four dual colour LEDs each arranged to selectively illuminate two colours of light (e.g., red and green). The LEDs are arranged to provide, among other indications, countdown and low battery indications. The LEDs are arranged in a recess 52 defined by generally oval shaped inner and outer walls 520, 521 connected by four radially extending ribs 52R in the top member 12C. The ribs define four recess portions each correspond to a respective LED. The upper surface of the top member 12C defines four water-droplet shaped recesses or windows 52W, each corresponding to a respective one of the LEDs of the array 50. A one-piece lens 58, or light guide, is disposed between the LED array 50 and the top member 12C. The lens 58 includes lens portions 58P each substantially flush with the top member 12C and received in a respective recess. Light from the respective LEDs is guided by the lens to the respective lens portions 58P for view by the user. Optionally, a touch on-off switch (not shown) for controlling on and off of the dispenser is arranged below the top member 12C at where the LEDs and lens 58 are arranged (e.g., region 84).

Referring now to FIGS. 1 to 3, the container 14 includes a generally cylindrical body with a flat base 14B and an annular neck 14N extending about an opening 140 arranged centrally at the top end 14A of the container 14. The top end 14A also includes a peripheral annular channel 60 sized to receive the lowermost edge 12L of the main body member 12B. The neck 14N extends along its axis Z. As shown in FIG. 2, the radially outer surface of the neck 14N may include a pen-annular peripheral rib 62 and a projection 64 elongated parallel to the axis Z and arranged at the middle section of the pen-annular peripheral rib 62. The pen-annular peripheral rib 62 includes an axially outer face acutely inclined to the axis Z and an axially inner face 621 generally perpendicular to the axis Z.

The coupler body 16 includes a skirt portion 16S complementary to the neck 14N and a flange 16F that extends transversely to the skirt portion 16S. The radially inner surface of the skirt portion 16S includes four radially inwardly extending peripheral ribs 66 arranged in substantially the same plane and distributed evenly on the inner surface. The peripheral ribs 66 have respective axially outer faces 660 acutely inclined to the axis Z and axially inner faces 661 generally perpendicular to the axis Z. The coupler body 16 also includes a suction tube 68 arranged centrally and defining a through-extending liquid passage with an outlet 70 at the top for fluidly coupling with the inlet 22 of the housing 12. The outlet 70 can receive the seal plug 20S of the plug 20. The suction tube 68 is coupled with an extension tube 73 that extends into the container 14 for drawing liquid in the container 14. An aperture 72 is disposed adjacent the outlet 70 on the top of the body 16 for receiving a locating plug 20L of the plug 20. The coupler body 16 also includes a complementary recess 74 for receiving the projection 64 of the neck 14N when the coupler body 16 is connected to neck 14N.

By aligning the projection 64 on the neck 14N and the recess 74 on the body 16 and then pressing the coupler body 16 onto the neck 14N along the axis Z, the peripheral ribs 66 of the coupler body 16, made of plastic, is forced over the peripheral rib 62 of the neck 14N. In particular, the outer faces 620, 660 of the respective ribs 62, 66 abut, slide past each other due to the inherent elasticity of plastic, and after which the substantially parallel inner faces 621, 661 of the respective ribs 62, 66 abut to prevent later removal of the coupler body, while engagement of the complementary recess 74 and projection 64 inhibits relative rotation between the coupler body 16 and the neck 14N about the axis Z. As a result the coupler body 16 is permanently fixed (i.e., difficult to remove manually without damaging or breaking one or more of the components of the dispenser) to the neck 14N. The permanent fixture prevents or at least discourages the users from manually refilling the container 14.

Circumferentially spaced projections 76 that extend radially outward are formed on the flange 16F of the coupler body 16 to engage with complementary circumferential slots 78 formed on the inner surface of the cap or complementary circumferential slots 78' formed on the inner surface of the sleeve portion of the housing. The complementary circumferential slots 78, 78' are each adapted to receive a respective one of the circumferentially spaced projections 76. Each circumferential slot 78, 78' includes a helical face 80, with a detent nub 82, which is arranged to engage the projection 76. Relative rotation between the coupler body 16 (when coupled to the container 14) and the sleeve portion 12BS of the housing 12 draws the container 14 and housing 12 together and connects the container 14 to the housing 12, fluidly coupling the outlet 70 of the coupler body 16 with the inlet 22 in the sleeve portion 12BS in a fluid tight manner. Alternatively, relative rotation between the coupler body 16 (when coupled to the container 14) and the cap 18 draws the container 14 and cap 18 together and connects the cap 18 to the container 14 to close or seal it.

The sealing plug 20 seals the through-extending liquid passage or the outlet 70, e.g., before the container 14 is coupled to the housing 12. The sealing plug 20 includes a web 20W extending transversely and a locating plug 20L aligned with the sealing plug 20S and integral with the web 18W. The locating plug 20S is arranged to be received in the outlet 70.

Figure 6:
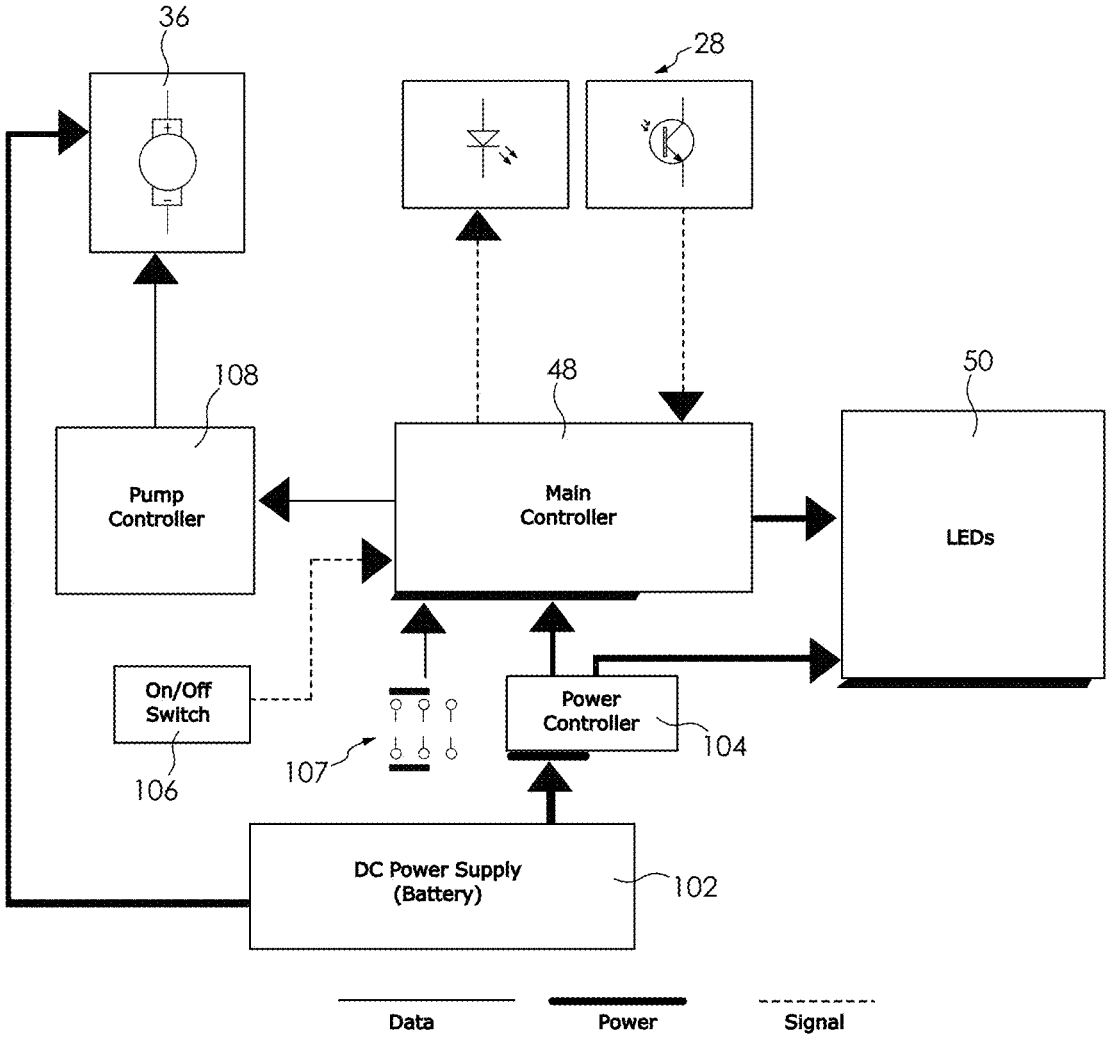
FIG. 6 is a circuit diagram of the dispenser of FIG. 1.

FIG. 6 shows the circuit arrangement 100 of the dispenser. The circuit arrangement 100 includes a DC power supply 102 provided by the batteries received in the battery receptacle 40. The DC power supply 102 is arranged to power the dispenser, and is electrically connected with the pump motor 36 and a power controller 104. The power controller 104 controls power distribution in the dispenser, including the power to provide to the LED array 50 and to the main controller 48. The main controller 48 is electrically connected with the infrared transmitter receiver pair 28, the LED array 50, the power controller 104, the on/off switch 106, and the pump controller 108. The main controller 48 is programmed to operate the dispenser as discussed in further detail below, and holds a timer that controls illumination of the LED array 50. The pump controller 108 controls operation of the pump motor 36. The circuit arrangement 100 also includes a motor operation duration circuit 107 arranged to set the amount of time the motor is operated upon activation of the photoelectric sensor. The amount of time may be, e.g., 1 second, 1.5 seconds.

Each of the controllers 48, 104, 108 may include a processor and a memory (storage). The processor may be formed by one or more of: CPU, MCU, controllers, logic circuits, Raspberry Pi chip, digital signal processor (DSP), application-specific integrated circuit (ASIC), Field-Programmable Gate Array (FPGA), or any other digital or analogue circuitry configured to interpret and/or to execute program instructions and/or to process signals and/or information and/or data. The memory may include one or more volatile memory (such as RAM, DRAM, SRAM), one or more non-volatile memory (such as ROM, PROM, EPROM, EEPROM, FRAM, MRAM, FLASH, SSD, NAND, and NVDIMM), or any of their combinations. Appropriate computer instructions, commands, codes, information and/or data may be stored in the memory.

In operation, a user inserts batteries into the battery receptacle 40, then connects the container 14 containing cleaning fluids and coupled with the coupler body 16 to the housing 12 by rotating the coupler body 16 relative to the sleeve portion 12BS of the housing 12, as discussed above. If the container 14 is initially mounted with the cap 18 and the plug 20 as well, the user needs to remove the cap 18 and the plug 20 prior to coupling the coupler body 16 to the housing 12.

The user turns on the dispenser by actuating the on/off switch 106 (by touching or pressing the part of the top member 12C centrally of the windows 58W. Upon detecting an "on" input from the user, the main controller 48 is arranged to control all LEDs of the array 50 to illuminate, in green colour, for 2 seconds. The dispenser is then at stand-by mode to detect user input for dispensing cleaning liquid at the transmitter and receiver pair 28.

To dispense cleaning liquids from the dispenser, the user places his or her hand below the nozzle 26. The infrared transmitter and receiver pair 28 adjacent the nozzle 26 then detects the presence of the user's hand, by detecting the infrared signal transmitted from the infrared transmitter reflected off the user's hand and picked up by the infrared receiver. The infrared receiver then transmits a signal to the main controller 48 to indicate presence of a user's hand. The main controller 48, upon receiving such signal, controls the pump controller 108 to activate the pump motor 36 for a predetermined period of time (e.g., 1 second) to dispense cleaning liquid and controls the LEDs of the array 50 to illuminate during the dispensing of the cleaning liquid.

The pump motor 36 then operates for that predetermined period of time to dispense cleaning liquid from the nozzle 26, while the LEDs of the array 50 illuminate in green colour as the motor 36 operates to dispense cleaning liquid.

Subsequently, the main controller 48 (with timer) controls the LEDs of the array 50 to provide a countdown display that indicates to the user the hand washing duration. Specifically, the main controller 48 triggers and starts a timer to begin the countdown immediately after expiry of the motor 36 activation, to actuate the LEDs of the array 50 successively at respective elapsed times measured by the timer. The main controller 48 controls: the LED corresponding to the smallest water droplet window to flash, in green colour, for 5 seconds (e.g., 1 flash per second) while all other LEDs are off; then the LED corresponding to the second smallest water droplet window to flash, in green colour, for 5 seconds (e.g., 1 flash per second) while the smallest LED corresponding to the smallest water droplet window illuminate continuously in green colour and all other LEDs are off; then the main controller 48 controls the LED corresponding to the third smallest water droplet window to flash, in green colour, for 5 seconds (e.g., 1 flash per second) while the smallest and the second smallest LEDs corresponding to the smallest and the second smallest water droplet windows illuminate continuously in green colour and all the remaining LED is off; and finally the LED corresponding to the largest water droplet window to flash, in green colour, for 5 seconds (e.g., 1 flash per second) while all other LEDs illuminate continuously in green colour. This arrangement provides a 20-second countdown to guide the user through the hand washing process to ensure that the user has washed and cleaned their hands for a sufficiently long period of time. After the countdown elapses, the controller 48 controls the smallest and the largest LEDs to illuminate red light and the second smallest and the second largest LEDs to illuminate green light (e.g., for 0.25 seconds); then the smallest and the largest LEDs to illuminate green light and the second smallest and the second largest LEDs to illuminate red light (e.g., for 0.25 seconds); alternately for a total of 3 seconds. Afterwards, the dispenser returns to stand-by mode to detect the next input for dispensing cleaning liquid.

After using the dispenser, the user can turn off the dispenser by actuating the on/off switch 106 (by touching or pressing the part of the top member 12C centrally of the windows 58W. Upon detecting an "off" input from the user, the main controller 48 is arranged to control all LEDs of the array 50 to illuminate, in red colour, for 2 seconds.

The main controller 48 is also arranged to control the LEDs to provide two levels of low power indication. When the power controller 104 detects that the power remaining the batteries are low (e.g., batteries voltage below a first threshold), the power controller 104 provides a signal to the main controller 48, such that in subsequent operation the LEDs of the array during countdown are changed to red colour. This provides an indication to the user that the batteries need to be replaced. If the power controller 104 detects that the power remaining the batteries are insufficient for operation (e.g., batteries voltage below a second threshold lower than the first threshold), when the infrared receiver detects the user's hand, all LEDs of the array will flash twice and then turn off, with no cleaning liquid dispensed from the dispenser.

Aspects of the invention have been described by way of example only. It should be appreciated that modifications and additions may be made to the specific embodiment disclosed without departing from the scope thereof. The described embodiments of the invention should therefore be considered in all respects as illustrative, not restrictive. For example, the construction of the housing of the dispenser may be different from that as shown. The spatial arrangement of components can be different. Other types of cleaning liquids can be used. The housing, coupler body, and container need not be entirely made of plastic. The power source of the dispenser need not be replaceable batteries, but can be rechargeable batteries, either hardwired to the device or replaceable. Charging means (e.g., USB, wireless charging, etc.) can be incorporated to the dispenser for charging the batteries. The circuit arrangement of the dispenser may be different from that as shown. The LED array may be replaced with or provided along with other visual or audible indicators. For example, the countdown time can be any time more or less than 20 seconds, the motor activation duration to dispense liquid can be more or less than 1 second, the colour and/or duration of the illumination of the LED of the array may differ (e.g., the illumination can be continuous or flashing). The dispenser assembly 10 may include the housing 12, the container 14, and the coupler body 16, without the cap 18 and the plug 20. Replacement containers formed by container 14 with coupler body 16 and containing cleaning solutions or liquids can be provided separately from the assembly 10.

The invention claimed is:

1. A cordless benchtop dispenser for dispensing cleaning liquids, the cordless benchtop dispenser comprising:

a container with a neck that comprises an axis and at least one first peripheral rib, the neck extending along the axis and about an opening;

a housing with a lower part that is configured to rest on top of the container and which defines a liquid inlet, and an upper projecting part holding a nozzle;

a motor-driven pump in the housing for drawing liquid through the liquid inlet and dispensing the liquid from the nozzle;

a coupler body comprising a skirt portion complementary to the neck, the skirt portion comprising at least one second peripheral rib, a through-extending liquid passage in the coupler body, a suction tube fixed to the coupler body and defining a length of the through-extending liquid passage, wherein male coupler features comprise a plurality of circumferentially spaced projections that extend radially, and complementary female coupler features comprise a plurality of circumferential slots each adapted to receive a respective one of the circumferentially spaced projections, and one of the male and female coupler features is disposed on the coupler body, and the other of the male and female coupler features is disposed on the housing such that relative rotation connects the housing to the container, wherein, by pressing the coupler body onto the neck and thereby forcing the second peripheral rib over the first peripheral rib, the coupler body is permanently fixed to the neck, axially opposing sides of the first and second peripheral ribs have respective inner and outer faces, the outer faces are acutely inclined to the axis of the neck and abut one another when forcing the second peripheral rib over the first peripheral rib, the inner faces subsequently abut to prevent removal of the coupler body, wherein an angle of inclination of the inner faces to the axis is greater than an angle of inclination of the outer faces to the axis, and wherein one of a recess and complementary projection are integrally formed with the neck and the other of the recess and complementary projection are integrally formed with the coupler body, to prevent relative rotation between the coupler body and the neck about the axis.

2. The cordless benchtop dispenser of claim 1, wherein the circumferential slot comprises a helical face that engages the projection, such that the relative rotation draws the container and housing together, and wherein the helical face further comprises a detent nub.

3. The cordless benchtop dispenser of claim 1, wherein the circumferentially spaced projections are formed in a flange that extends transversely to the skirt portion, and the circumferential slots are formed inside a sleeve portion of the housing.

4. The cordless benchtop dispenser of claim 3, wherein the housing comprises: a hollow main body member with a lowermost edge sized to rest in an annular channel in the top of the container, and a base member recessed inside the lowermost edge to cover a lower end of the hollow main body member.

5. The cordless benchtop dispenser of claim 4, wherein the sleeve portion is formed in the base member.

6. The cordless benchtop dispenser of claim 4, wherein the upper projecting part of the housing comprises abutting sections of the hollow main body member and a top member that covers a top end of the hollow main body member.

7. The cordless benchtop dispenser of claim 4, wherein an outer end of the upper projecting part is closed by an elliptical member, a perimeter of the elliptical member received in arcuate slots in the hollow main body member and top member.

8. The cordless benchtop dispenser of claim 1, wherein the dispenser further comprises a sealing plug for temporarily sealing the through-extending liquid passage, wherein the sealing plug further comprises a web extending transversely and a locating plug aligned with the sealing plug and integral with the web, wherein an aperture is disposed adjacent the through-extending liquid passage for receiving the locating plug.

9. A cordless benchtop dispenser for dispensing cleaning liquids, the cordless benchtop dispenser comprising:

a container, a coupler body, and a housing, the housing having a lower part that is configured to rest on top of the container and which defines a liquid inlet, and an upper projecting part holding a nozzle;

a motor and a pump driven by the motor in the housing for drawing liquid through the coupler body and the liquid inlet and dispensing the liquid from the nozzle;

a photoelectric sensor adjacent the nozzle;

a power supply in the housing;

an indicator arranged on the housing and comprising an array of light emitters disposed in at least one recess in the housing;

a control circuit connected to the power supply and photoelectric sensor and comprising a controller for controlling the motor and the indicator, wherein activation of the photoelectric sensor triggers the controller to operate the motor for a predetermined period, and subsequently triggers the controller to start a timer and actuate the light emitters successively at respective elapsed times measured by the timer.

10. The cordless benchtop dispenser of claim 9, wherein a different elapsed time is associated with each light emitter and the elapsed times are predetermined.

11. The cordless benchtop dispenser of claim 9, deactivation of the motor triggers the controller to start the timer.

12. The cordless benchtop dispenser of claim 9, wherein the at least one recess comprises a separate emitter-receiving recess for receiving each emitter.

13. The cordless benchtop dispenser of claim 12, further comprising a one-piece lens with lens portions substantially flush with the housing and received in each of the emitter-receiving recesses.

14. The cordless benchtop dispenser of claim 11, wherein the emitter-receiving recesses are disposed in an uppermost member of the housing and the light emitters comprise LEDs mounted on a circuit board fixed to the uppermost member.

15. The cordless benchtop dispenser of claim 14, wherein the uppermost member is reinforced near the emitter-receiving recesses by integral internal ribs.

16. The cordless benchtop dispenser of claim 9, further comprising a translucent cover that extends over the photoelectric sensor and the nozzle extends through an opening in the translucent cover.

17. A cordless benchtop dispenser for dispensing cleaning liquids, the cordless benchtop dispenser comprising:

a container with a neck that comprises an axis and at least one first peripheral rib, the neck extending along the axis and about an opening;

a housing with a lower part that is configured to rest on top of the container and which defines a liquid inlet, and an upper projecting part holding a nozzle;

a motor-driven pump in the housing for drawing liquid through the liquid inlet and dispensing the liquid from the nozzle;

a coupler body comprising a skirt portion complementary to the neck, the skirt portion comprising at least one second peripheral rib, a through-extending liquid passage in the coupler body, a suction tube fixed to the coupler body and defining a length of the through-extending liquid passage, wherein male coupler features comprise a plurality of circumferentially spaced projections that extend radially, and complementary female coupler features comprise a plurality of circumferential slots each adapted to receive a respective one of the circumferentially spaced projections, and one of the male and female coupler features is disposed on the coupler body, and the other of the male and female coupler features is disposed on the housing such that relative rotation connects the housing to the container, and wherein, by pressing the coupler body onto the neck and thereby forcing the second peripheral rib over the first peripheral rib, the coupler body is permanently fixed to the neck and the circumferentially spaced projections are formed in a flange that extends transversely to the skirt portion, and the circumferential slots are formed inside a sleeve portion of the housing.

18. A cordless benchtop dispenser for dispensing cleaning liquids, the cordless benchtop dispenser comprising:

a container with a neck that comprises an axis and at least one first peripheral rib, the neck extending along the axis and about an opening;

a housing with a lower part that is configured to rest on top of the container and which defines a liquid inlet, and an upper projecting part holding a nozzle;

a motor-driven pump in the housing for drawing liquid through the liquid inlet and dispensing the liquid from the nozzle;

a coupler body comprising a skirt portion complementary to the neck, the skirt portion comprising at least one second peripheral rib, a through-extending liquid passage in the coupler body, a suction tube fixed to the coupler body and defining a length of the through-extending liquid passage, wherein male coupler features comprise a plurality of circumferentially spaced projections that extend radially, and complementary female coupler features comprise a plurality of circumferential slots each adapted to receive a respective one of the circumferentially spaced projections, and one of the male and female coupler features is disposed on the coupler body, and the other of the male and female coupler features is disposed on the housing such that relative rotation connects the housing to the container, and wherein, by pressing the coupler body onto the neck and thereby forcing the second peripheral rib over the first peripheral rib, the coupler body is permanently fixed to the neck, wherein the dispenser further comprises a sealing plug for temporarily sealing the through-extending liquid passage, wherein the sealing plug further comprises a web extending transversely and a locating plug aligned with the sealing plug and integral with the web, wherein an aperture is disposed adjacent the through-extending liquid passage for receiving the locating plug.

* * * * *